US005695310A

United States Patent [19]

Foster et al.

[11] Patent Number: 5,695,310

[45] Date of Patent: Dec. 9, 1997

[54] LINKAGE ARRANGEMENT FOR A LOADING MACHINE

[75] Inventors: Kent M. Foster, Maple Park, Ill.; Gregory A. Loebbaka, Wamego, Kans.

[73] Assignee: Caterpillar Inc., Peoria, Ill.

[21] Appl. No.: 682,825

[22] Filed: Jul. 12, 1996

[51] Int. Cl.[6] ..... E02F 3/38

[52] U.S. Cl. ..... 414/685; 414/722

[58] Field of Search ..... 414/685, 697, 414/700, 701, 698, 699, 722

[56] References Cited

U.S. PATENT DOCUMENTS 4,163,498 8/1979 Grooss et al. ..... 414/697
4,768,917 9/1988 Garman ..... 414/701 X
5,595,471 1/1997 Ajilore ..... 414/685
5,599,158 2/1997 Ajilore ..... 414/685

*Primary Examiner*—Donald W. Underwood
*Attorney, Agent, or Firm*—William C. Perry

[57] ABSTRACT

Typical loading machines utilize a pair of lift arms to mount a work implement to a machine frame. The spacing of the lift arms and the tilt linkage mounted to the lift arms to manipulate the work implement reduce the visibility to the work implement as well as increase the overall weight of the structure. The present invention provides a boom-type lift arm that has a non-clevised configuration on both end portions thereof that mount a work implement to the frame of a machine. The tilt linkage is mounted between the lift arm and the work implement to rotate the work implement with respect to the lift arm. The work implement defines a pair of mounting plates that mount both the tilt linkage as well as the lift arm.

12 Claims, 4 Drawing Sheets

LINKAGE ARRANGEMENT FOR A LOADING MACHINE

TECHNICAL FIELD

This invention relates to a linkage arrangement and more particularly to a linkage arrangement that mount a work implement to a construction machine such as a loader.

BACKGROUND ART

In the operation of earthworking machines such as wheel loaders it is common practice to mount a bucket to the front of the machine by a pair of lift arms. Each lift arm is spaced from one another a distance that is slightly more narrow that the width of the bucket. The lift arms and therefore the bucket, are normally raised and lowered in a generally vertical plane by a pair of lift cylinders that are connected to each lift arm. A tilting arrangement for the bucket is provided in one of many types of linkage arrangements that are connected between the lift arm and the bucket and are actuated by a tilt cylinder that extends from the wheel loader to the tilt linkage arrangement to pivot the bucket with respect to the lift arm. One of the major drawbacks to this type of arrangement is that the visibility to the corner of the bucket is obstructed by the spread relationship of the lift arms, in the event that the design of the tilt linkage is such that it two is spread, the tilt linkage may also hinder visibility to the bucket.

One remedy for this situation is to provide a lift arm that is one piece and is positioned between the bucket and the machine generally along the centerline of the machine. One such design is disclosed in U.S. Pat. No. 4,768,917 issued to Anthony L. Garman on Sep. 6, 1988. While this design does improve the visibility to the corners of the bucket, the overall linkage configuration, especially in the area of the tilting arrangement is configured such that an excessive amount of mass is required in the areas of high stress. Since the tilt lever is connected to the bucket at the upper mid-portion thereof, the tilt linkage must be sized to accommodate twisting forces transferred through the arrangement during the loading of the bucket. The increase in mass and additional componentry will dramatically increase the weight of the linkage arrangement and thereby adversely affect the performance capability of the linkage.

Still other designs utilize a boom-type lift arm that have a spread or clevised end at one or both ends thereof where the lift arm is mounted to either the frame or the work implement. While these clevised end portions work well for load distribution, they also increase the mass of the lift arm and therefore, the overall weight of the linkage. In these applications, various ones of the tilt linkage components are also clevised, especially where the link is attached to the work implement. In many instances, the distance between the clevised tilt link and the clevised end portion of the lift arm are different sizes. While this is extremely effective as far as load distribution between the work implement and the lift arm is concerned, the structural components required on the work implement to accommodate the two components is often excessive. This also has been known to increase the weight and therefore the cost of the linkage.

The present invention is directed to overcoming one or more of the problems set forth above.

DISCLOSURE OF THE INVENTION

In one aspect of the present invention, a linkage arrangement for a loader is provided. The loader includes a frame having a pair of mounting plates positioned in spaced, parallel relation to each other a first preselected distance. A work implement is provided that has a pair of mounting plates positioned in spaced, parallel relation to one another a distance that is equal to the first preselected distance. A boom member is included that has first and second end portions and a pair of trunnion members extending from opposite sides thereof at a location substantially midway between the end portions. The trunnions have distal end portions that are spaced from one another a distance that is greater than the first preselected distance. The first end portion of the boom member is pivotally mounted to the mounting plates defined by the frame while the second end portion is mounted to the mounting plates defined by the work implement. A pair of first fluid actuators have a first end portion mounted to the frame and a second end portion mounted to opposing distal end portions of the respective trunnions. A pair of first tilt links have a first end portion mounted to opposing sides of the boom member and a second end portion. A second tilt link has a first bifurcated end portion pivotally mounted between the second end portions of the first tilt links and a second end portion pivotally mounted between the mounting plates defined by the work implement. A second fluid actuator has a first end portion mounted to the frame and a second end portion mounted to the bifurcated first end portion of the second tilt link along a common axis with the mounting between the second link and the second end portions of the first tilt links.

With a linkage arrangement as set forth above, an implement may be mounted to a machine in a manner that utilizes a very narrow boom member to provide good visibility for the operator of the machine to the corners of the work implement. In addition, since the second tilt lever and the boom member have essentially the same mounting width, the work implement need only be provided with a pair of main mounting plates to accommodate the mounting of both members. This reduces the components required in the support structure of the work implement and thereby reduces the cost of the work implement as well as the manufacturing thereof.

BEST MODE FOR CARRYING OUT THE INVENTION

Figure 1:
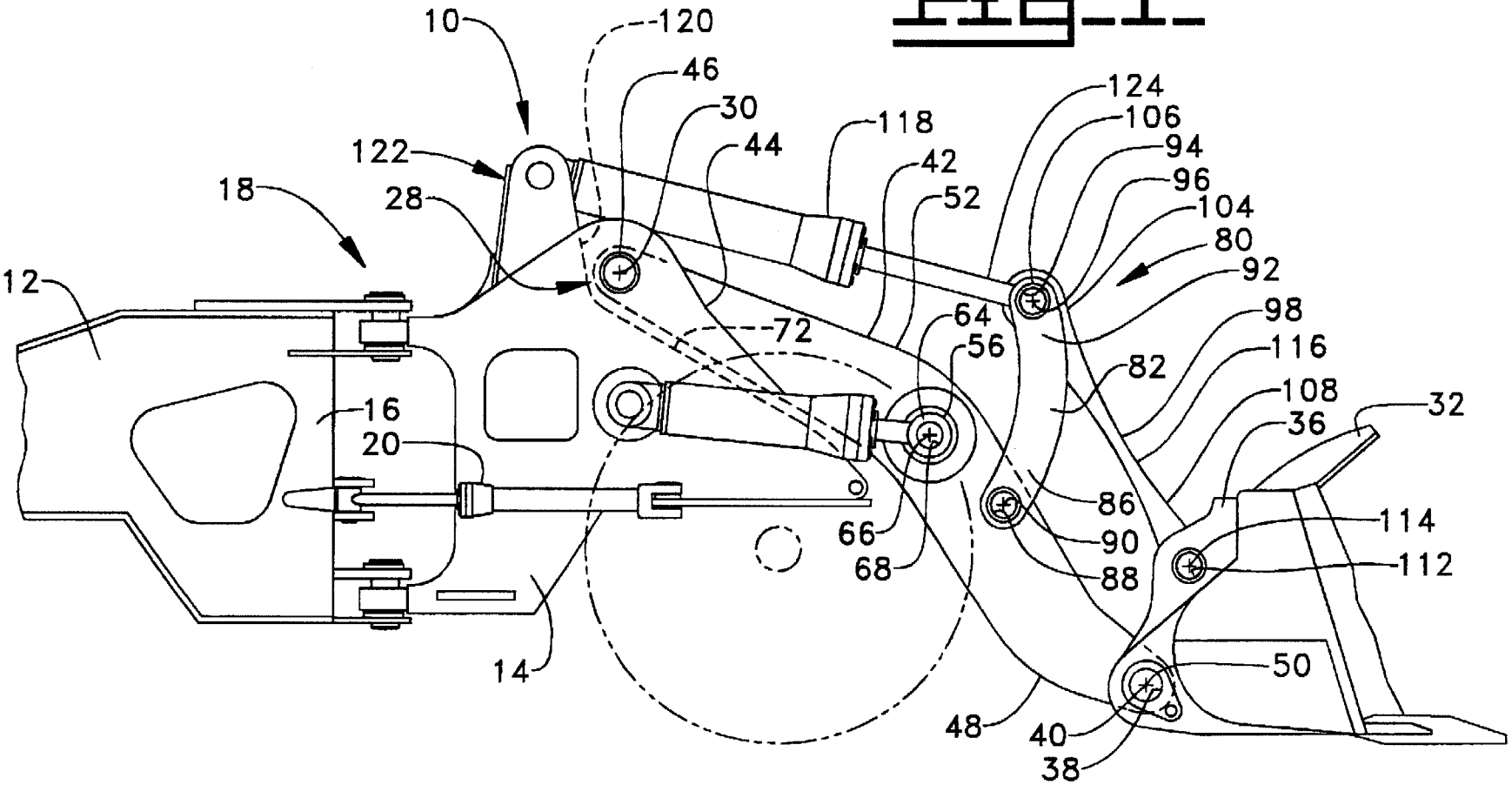
FIG. 1 is a diagrammatic side view of a portions of loading machine embodying the principles of the present invention.

Referring to the drawings it can be seen that a portion of a machine 10 such as a loader, is shown. The machine in this particular instance has a frame portion 12 that mounts a front wheel assembly 14. The front frame portion is mounted to a rear frame assembly 16, which is only partially shown, through an articulation hitch that is generally at 18. A pair of steering cylinders 20 are mounted between the front and rear frame members on opposite sides of the machine centerline 22 and operate to rotate the front frame member about articulation hitch to provide steering of the machine. The front frame 14 defines a pair of side plates 24 and 26 that are spaced from one another a preselected distance "A" and are positioned parallel to one another on opposite sides of the machine centerline 22. Each side plate defines a mounting bore 28 that is positioned in alignment with one another along a common axis 30.

A work implement 32 is also mounted to the front frame 14. In the illustrated embodiment, the work implement is a bucket and is utilized to load various types of material for placement in a truck or to otherwise remove the material from the area in a well known manner. The work implement 32 defines a pair of mounting plates 34 and 36 on a rearwardly directed face thereof that are positioned parallel to one another and are spaced apart a distance that is equal to the preselected distance "A" separating the side plates defined by the frame 14. Each mounting plate 34 and 36 defines a bore 38 and each bore is aligned with the other along a common axis 40.

Figure 4:
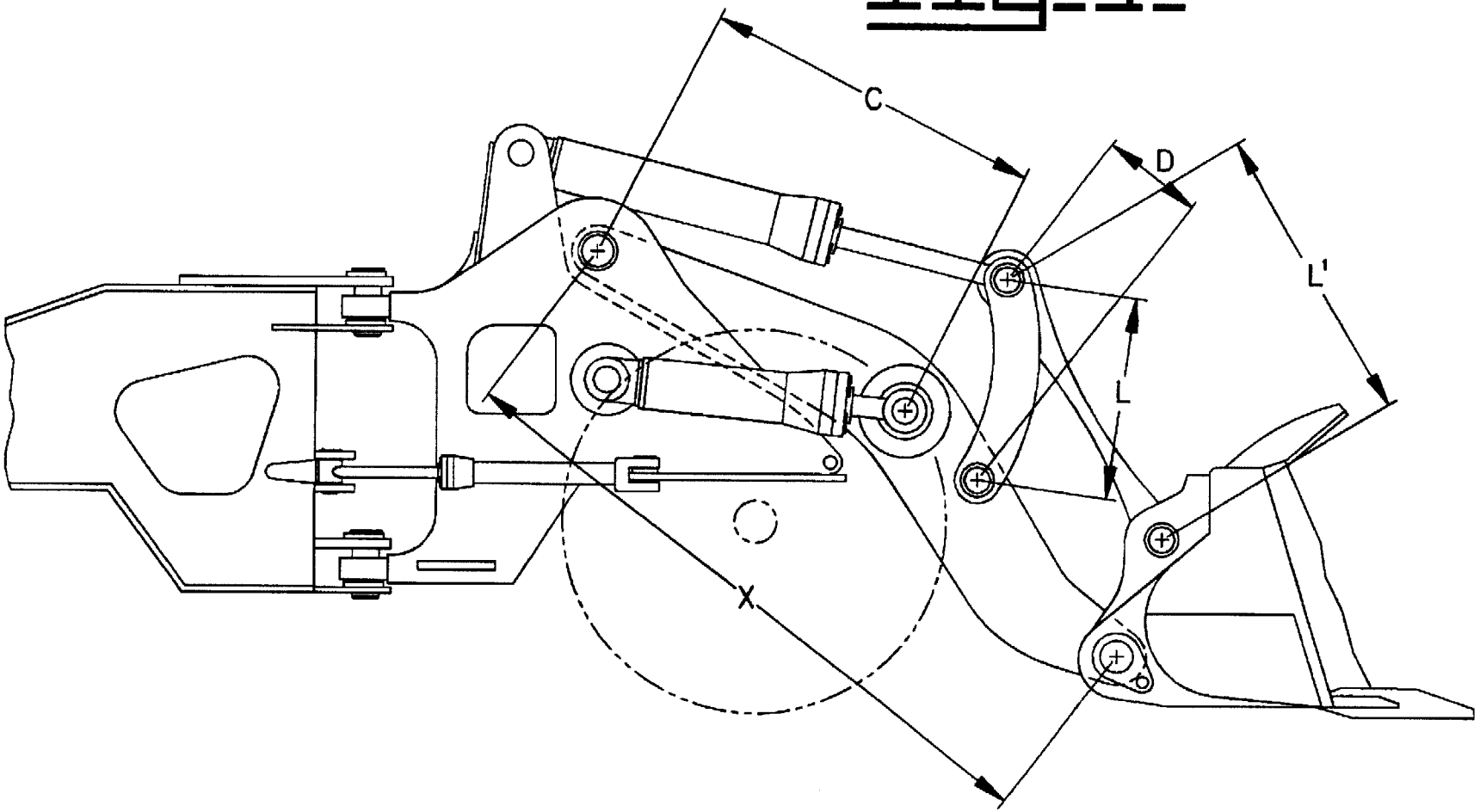
FIG. 4 is a diagrammatic isometric view of the linkage arrangement similar to that of FIG. 3 showing the various critical dimensions between the components of the invention.

The work implement 32 is mounted to the frame member 14 by a boom-type lift arm 42. The lift arm has a first, non-clevised end portion 44 that has a bore (not shown) extending therethrough. The first end portion 44 of the boom is positioned between the side plates 24 and 26 of the frame member 14 along the axis 30. The aligned bores in the side plates and lift arm receive a pin assembly 46 to pivotally mount the boom member 42 for movement with respect to the frame along a generally vertical plane. A second end portion 48 of the lift arm is also non-clevised and defines a bore (not shown) therethrough. The second end portion 48 is mounted between the mounting plates 34 and 36 defined by the work implement 32 along the axis 40 and is pivotally mounted to the work implement by a pin assembly 50 for movement with respect to the lift arm along the generally vertical plane. The distance between the axes 30 and 40 about which the mountings the lift arm to the frame 14 and work implement 32 respectively extend, is a preselected distance "X" (FIG. 4).

Figure 2:
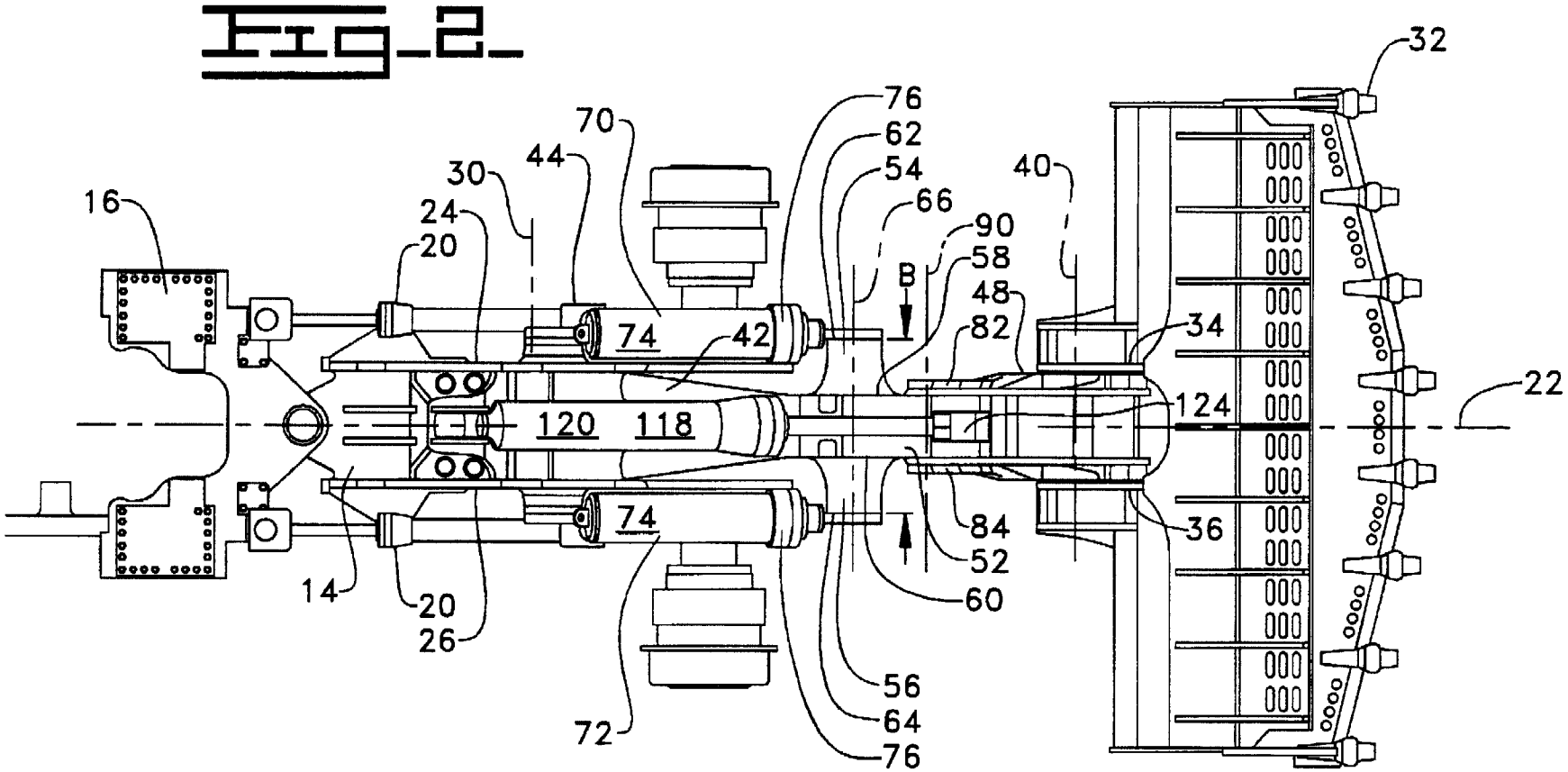
FIG. 2 is a diagrammatic top view of the structure shown in FIG. 1.

A central portion 52 of the lift arm that connects the two end portions 44 and 46 is reduced in width from side to side compared to each of the end portions. In this region of the lift arm, a pair of trunnions 54 and 56 are defined that extend laterally from each of an opposing side plate 58 and 60 of the lift arm. Each trunnion member defines a distal end portion 62 and 64 that are spaced from each other a preselected distance "B" (FIG. 2) that is greater than the preselected distance "A" defined between the side plates 24 and 26 of the frame 14. The trunnions 54 and 56 are aligned with one another on opposite sides of the lift arm along an axis 66 and bore 68 (one shown) is positioned to open on to the distal end 62 and 64 of each trunnion about the axis 66. Alternatively, a single bore could extend entirely through the aligned trunnions and the lift arm. The axis 66 is spaced from the axis 30 a preselected distance "C" (FIG. 4).

Figure 3:
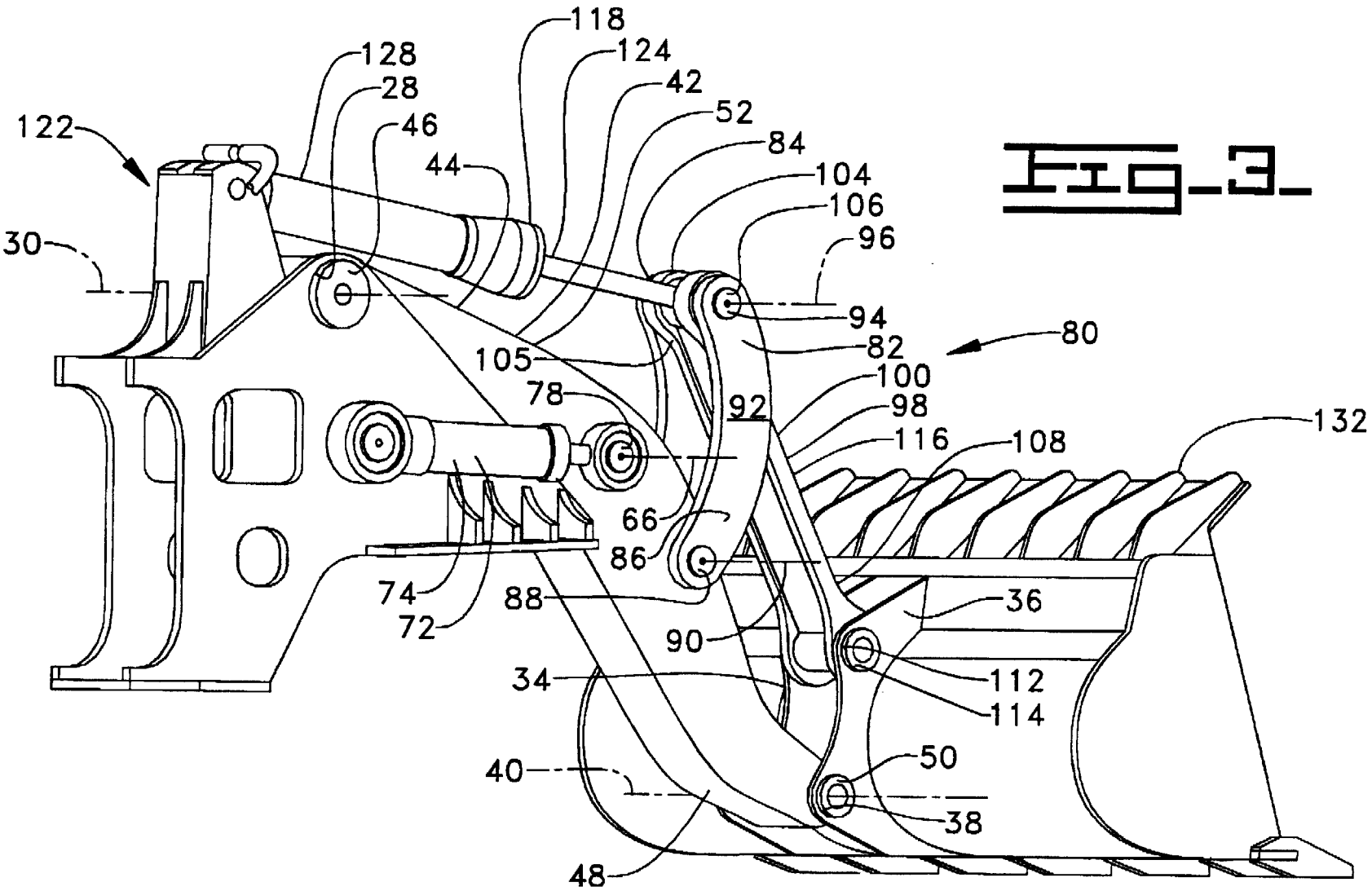
FIG. 3 is a diagrammatic isometric view of the linkage arrangement as viewed from the right rear of the work implement.

The lift arm 42 is moved along the vertical plane by a pair of lift cylinders 70 and 72 that are positioned on opposite side of the lift arm 42. Each lift cylinder has a first end portion 74 pivotally mounted to the frame member 14 and a second end portion 76 mounted to one of the respective distal ends 62 and 64 of the trunnions 54 and 56 respectively. A pin assembly 78 (FIG. 3) is positioned within the bores 68 defined by the trunnions to pivotally mount the lift cylinders to the lift arm. Extension and retraction of the lift cylinders in a well known manner causes movement of the lift arm with respect to the frame.

The work implement 32 is rotated about pin assembly 50 by a tilt link arrangement shown generally at 80. The tilt link arrangement 80 includes a pair of first tilt links 82 and 84 that are essentially identical to one another. Each of the first tilt links 82 and 84 are spaced from one another on opposing sides of the lift arm 42. Each of the first tilt links has a first end portion 86 pivotally mounted to the lift arm by a pin assembly 88 that is located on an axis 90 that is positioned between the axis 66 defined by the trunnions 54 and 56 and the work implement 32. The mounting axis 90 of the first end portions 86 of the first tilt links is spaced from the mounting axis 66 defined by the trunnions by a preselected distance "D" (FIG. 4). The ratio between the distance "D" and the distance "C" that defines the distance between the mounting of the lift arm 42 to the frame 14, is within a range of 0.3 to 0.45. Each of the first tilt links define a second end portion 92 that extends upwardly from the first end portion 86 and defines a bore 94 which are aligned with one another along an axis 96. The first tilt links have a predetermined length "L" (FIG. 4) between the axes 90 and 98 and have a slightly curved configuration that direct them slightly rearwardly, away from the work implement 32. The ratio between the predetermine length "L" and the predetermined length "X", that extends between the axes 30 and 40, is approximately 0.25 to 0.33.

A second tilt link 98 has a first end portion 100 that defines a pair of bifurcated arms 102 and 104 and has a bore (not shown) extending therethrough. The first end portion 100 is positioned in alignment with the bores 94 in the second end portions 92 of the first tilt links 82 and 84 and they are pivotally mounted to one another by a pin assembly 106. A second end portion 108 of the second tilt link 98 also has a bore (not shown) extending therethrough and is positioned between the mounting plates 34 and 36 defined by the work implement 32. The mounting plates 34 and 36 have a pair of bores 112 defined at a location that is elevationally above that of the pin assembly 50 than mounts the lift arm 42 to the work implement 32. The second end portion 108 of the second tilt link 98 is positioned in alignment with the bores 112 and is pivotally mounted to the work implement by a pin assembly 114. The second tilt link 98 has a dog-bone shape, having enlarged first and second end portion 100 and 108 that are connected by a central portion 116 that is relatively planar having a thickness less than the diameter of the bores defined the respective end portions 100 and 108. The second tilt link has a preselected length "L'" between its pivotal mountings 106 and 114. The ratio between the preselected length of the first tilt links "L", with respect to the preselected length "L'" is approximately 0.62 to 0.72.

A second hydraulic cylinder 118 or tilt cylinder is positioned between the frame 14 and the tilt link arrangement 80. A first end portion 120 of the tilt cylinder 118 is pivotally mounted to a tower assembly 122 defined by the frame 14 along the centerline 22 of the machine 10. The tilt cylinder 118 extends forwardly and has a second end portion 124 that is positioned between the bifurcated arms 102 and 104 and is pivotally mounted along the axis 96 by the pin assembly 106. Extension and retraction of the tilt cylinder 118 will cause movement of the work implement 32 relative to the lift arm 42 along the vertical plane.

Industrial Applicability

In operation, a wheel loader is utilized to excavate material by driving the bucket 32 into a pile of material under motive force of the machine. The lift cylinders 70 and 72 and the tilt cylinder 118 are extended and retracted in coordination with one another to break the material loose, fill the bucket and lift the material from the pile. The material may then be loaded into a nearby dump truck or the wheel loader may be driven to a remote site to dump the material from the bucket. As the loading of the bucket takes place, it is very beneficial for the operator of the wheel loader to be able to see the corners of the bucket. This is not only important when working in close quarters at ground level but also when dumping material in the bed of a truck. With respect to truck loading, the bucket is rotated to dump the material from the bucket and the lower edge of the bucket often is moved below the elevation of the side of the truck. When the operator has good visibility, he can readily see when the bucket has been racked back an amount sufficient to clear the sides of the truck.

In addition to visibility, weight of the overall structure is also a major concern. While the loading through the linkage arrangement is known to be severe at times, it is very beneficial to provide a linkage arrangement that will accommodate this loading while utilizing individual components whose weight can be reduced as much as possible.

With the linkage arrangement set forth above, it can be seen that the lift arm 42 being of boom-type construction, is relatively narrow and is positioned along the centerline 22 of the machine 10. Being so constructed and arranged, visibility to the work implement, especially to the corners thereof is extremely good. Also, since the boom type linkage replaces the normal "pair" of lift arms, the tilt linkage required may be substantially reduced in size and in the number of components. This ultimately results in a linkage arrangement whose overall weight is greatly reduced while at the same time providing excellent visibility for operation.

Other aspects, objects and advantages of this invention can be obtained from a study of the drawings, the disclosure and the appended claims.

We claim:

1. A linkage arrangement, comprising:

a frame having a pair of mounting plates positioned in spaced, parallel relation to each other a first preselected distance;

a work implement having a pair of mounting plates positioned in spaced, parallel relation to one another a distance that is equal to the first preselected distance;

a boom member having first and second end portions and a pair of trunnion members extending from opposite sides thereof at a location substantially midway between said end portions, said trunnions having distal end portions that are spaced from one another a second preselected distance that is greater than the first preselected distance, said first end portion being pivotally mounted to the mounting plates defined by the frame and the second end portion mounted to the mounting plates defined by the work implement;

a pair of first fluid actuators each having a first end portion mounted to the frame and a second end portion mounted to opposing distal end portions of the respective trunnions;

a pair of first tilt links having a first end portion mounted to opposing sides of the boom member and a second end portion;

a second tilt link having a first, bifurcated end portion pivotally mounted between the second end portions of the first tilt links and a second end portion pivotally mounted between the mounting plates defined by the work implement; and a second fluid actuator having a first end portion mounted to the frame and a second end portion mounted to the bifurcated first end portion of the second tilt link along a common axis with the mounting between the second link and the second end portions of the first tilt links.

2. The linkage arrangement as set forth in claim 1 wherein each mounting plate defined by the frame defines a bore, said bores being aligned with one another along a first axis.

3. The linkage arrangement as set forth in claim 1 wherein the first and second end portions of the boom member are non-clevised and substantially of equal width.

4. The linkage arrangement as set forth in claim 3 wherein the boom member defines a centrally disposed connecting portion that extends between the first and second end portions and has a width that is less than that of the first and second end portions.

5. The linkage arrangement as set forth in claim 4 wherein the trunnion members extend from opposing sides of the connecting portion of the boom member and a bore is defined though both trunnion members and the boom member along a common axis.

6. The linkage arrangement as set forth in claim 1 wherein the frame defines a portion of a construction machine that defines a centerline and the boom member is substantially centered along a said centerline.

7. The linkage arrangement as set forth in claim 1 wherein the first tilt links have a curved profile, said second end portions thereof being directed toward the frame and away from the work implement.

8. The linkage arrangement as set forth in claim 1 wherein the first tilt links have a preselected length and the boom member has a preselected length, and the ratio of the length of the first links with respect to the length of the lift arm is approximately 0.25 to 0.33.

9. The linkage arrangement as set forth in claim 8 wherein the second tilt link has a preselected length and the ratio between the preselected length of the first tilt links with respect to the preselected length of the second link is approximately 0.62 to 0.72.

10. The linkage arrangement as set forth in claim 1 wherein the second tilt link defines a centrally disposed connecting portion that is positioned between first and second enlarged end portions.

11. The linkage arrangement as set forth in claim 6 wherein the boom member, the second tilt link and the second fluid actuator are substantially vertically aligned along the centerline of the machine.

12. The linkage arrangement as set forth in claim 1 wherein the mounting between the boom member and the second end portions of the first fluid actuators is spaced from the mounting between the boom member and the first end portions of the first tilt links a second preselected distance, and the mounting between the boom member and the second end portions of the first fluid actuators is spaced from the mounting between the first end portion of the boom member and the frame a third preselected distance, and the ratio between the preselected distance between the mounting of the boom and the first end portions of the first tilt links and the mounting between the boom and the second end portions of the first fluid actuator is approximately 0.3 to 0.45.

* * * * *